US008646232B2

(12) United States Patent
Liskey

(10) Patent No.: US 8,646,232 B2
(45) Date of Patent: Feb. 11, 2014

(54) FOUNDATION CONSTRUCTION FOR SUPERSTRUCTURES

(75) Inventor: Herbert Gregory Liskey, Winter Garden, FL (US)

(73) Assignee: Mack Industries, Inc., Valley City, OH (US)

( * ) Notice: Subject to any disclaimer, the term of this patent is extended or adjusted under 35 U.S.C. 154(b) by 0 days.

(21) Appl. No.: 13/247,655

(22) Filed: Sep. 28, 2011

(65) Prior Publication Data

US 2012/0023847 A1 Feb. 2, 2012

Related U.S. Application Data

(62) Division of application No. 11/959,857, filed on Dec. 19, 2007, now Pat. No. 8,056,299.

(60) Provisional application No. 60/906,478, filed on Mar. 12, 2007.

(51) Int. Cl.
*E02D 27/00* (2006.01)

(52) U.S. Cl.
USPC ..... 52/295; 52/294; 52/583.1; 405/239

(58) Field of Classification Search
USPC ..... 52/125.2, 126.5, 292, 294, 295, 296, 52/297, 583.1, 741.1, 742.14, 742.16; 405/231–233, 239, 256, 257, 244
See application file for complete search history.

(56) References Cited

U.S. PATENT DOCUMENTS 1,647,925 A * 11/1927 May ..... 52/223.5
1,958,889 A * 5/1934 Fish ..... 52/297
2,625,815 A * 1/1953 Black ..... 52/126.1
2,690,074 A * 9/1954 Jones ..... 52/167.1
2,974,910 A 3/1961 Lynn
3,307,809 A 3/1967 Lynn
3,321,160 A 5/1967 Turnbull
3,540,763 A * 11/1970 Yee ..... 403/265
4,060,994 A * 12/1977 Chitis ..... 405/238
4,095,389 A * 6/1978 Outram et al. ..... 52/848
4,162,596 A 7/1979 Damman
4,218,859 A 8/1980 Sams
4,272,929 A * 6/1981 Hanson ..... 52/40
4,282,693 A 8/1981 Merklinger
4,293,242 A * 10/1981 Merjan ..... 405/239
4,331,314 A 5/1982 Chacour et al.
4,558,850 A 12/1985 Melfi (Continued)

FOREIGN PATENT DOCUMENTS

JP 06240877 A 8/1994

*Primary Examiner* — Brian Glessner
*Assistant Examiner* — Adam Barlow
(74) *Attorney, Agent, or Firm* — Pearne & Gordon LLP

(57) ABSTRACT

The installation of a foundation enables a superstructure to be installed and supported in a desired attitude such as a vertical attitude at the foundation. An installation template is placed at the selected location and support sites on the installation template can be adjusted so that the installation template will support the foundation subassembly in a manner such that the superstructure can be supported in said desired attitude. The foundation subassembly is placed onto the installation template using a lifting subassembly that is secured to the foundation subassembly. The foundation subassembly is fixed in place by concrete or the like into which the foundation assembly is inserted. The superstructure can then be secured to the foundation subassembly. The superstructure can comprise a post adapted to hold a panel for deflecting road noise.

23 Claims, 6 Drawing Sheets

(56) References Cited

U.S. PATENT DOCUMENTS

| | | | | |
|---|---|---|---|---|
| 4,605,090 | A | 8/1986 | Melfi | |
| 4,716,696 | A * | 1/1988 | Yacoboni | 52/169.9 |
| 4,862,992 | A | 9/1989 | Melfi | |
| 4,999,966 | A * | 3/1991 | Johnson et al. | 52/741.14 |
| 5,234,288 | A | 8/1993 | Bone | |
| 5,429,455 | A * | 7/1995 | Bone | 405/239 |
| 5,678,382 | A * | 10/1997 | Naito | 52/745.21 |
| 5,732,525 | A * | 3/1998 | Mochizuki et al. | 52/848 |
| 7,055,251 | B1 | 6/2006 | Smith | |
| 7,191,528 | B2 | 3/2007 | Smith et al. | |
| 7,614,200 | B2 * | 11/2009 | Wobben | 52/741.14 |

* cited by examiner

FOUNDATION CONSTRUCTION FOR SUPERSTRUCTURES

BACKGROUND OF THE INVENTION

This invention in general concerns methods and apparatus relating to structures comprising a stable base or foundation for supporting a superstructure, including such structures where both the foundation and the superstructure are substantially elongated relative to any of their lateral dimension.

There are numerous instances in the construction arts where a stable base or foundation is provided for a superstructure that is joined to and supported at the foundation. In many of these instances, the foundation is in contact with or confined within an earthen structure in which case the foundation may be variously preformed or cast in situ. In certain cases, the foundations are substantially elongated relative to any of their lateral dimensions and in some of these latter instances the superstructures also are substantially elongated relative to any of their lateral dimensions.

Examples of instances where both the foundations and the superstructures are elongated relative to any of their lateral dimensions include structures or assemblies where the foundations are in the nature of columnar structures such as piers or piles and the superstructures supported by the columnar structures are in the nature of poles or posts. Such structures are used, for example, in the construction of barrier walls erected along highways and the like to shield nearby residences and/or commercial establishments, for example, from traffic noises. The barrier walls are of the post and panel type wherein spaced-apart posts or columns, having grooves or slots in which noise-shielding panels are held, are supported on columnar foundations that are established in the surrounding ground.

SUMMARY OF THE INVENTION

The following presents a simplified summary of the invention in order to provide a basic understanding of some example aspects of the invention. This summary is not an extensive overview of the invention. Moreover, this summary is not intended to identify critical elements of the invention nor delineate the scope of the invention. The sole purpose of the summary is to present certain concepts of the invention in simplified form as a prelude to the more detailed description that is presented later.

According to one aspect, the invention provides for a method of installing a foundation that includes a foundation subassembly at a selected location so that a superstructure can be installed and supported in a desired attitude at the foundation. An installation template is placed at the selected location in a manner to support the foundation subassembly at the selected location. The installation template has support sites for supporting the foundation subassembly from support sites associated with the foundation subassembly. The attitude of the support sites on the installation template is adjusted so that the installation template will support the foundation subassembly in a manner such that the superstructure can be supported in said desired attitude at the foundation. The foundation subassembly is placed onto the installation template so that the support sites associated with the foundation subassembly and the support sites on the installation template engage one another and the foundation subassembly is supported at the selected location by the installation template. The foundation subassembly is fixed in place at the selected location to establish the foundation. The superstructure can then be installed and secured to the foundation subassembly.

In this and the other aspects of the invention referred to below, the superstructure and the foundation assembly can be elongated lengthwise relative to their lateral dimensions and the desired attitude of the superstructure can be a vertical attitude. For example, the superstructure can comprise a post installed in a vertical attitude and adapted to hold in place a panel for deflecting road noise.

According to a particular aspect, a confined, substantially unset concrete mass having an upper surface is provided at the selected location and the installation template is placed over the upper surface of the confined, substantially unset concrete mass in a manner to support the foundation subassembly in the confined, substantially unset concrete mass. The foundation assembly is inserted into the confined, substantially unset concrete mass through the upper surface of the concrete mass. This can be accomplished by raising a lifting assembly secured to an upper surface of the foundation assembly that comprises a support surface for the superstructure and then lowering the lifting assembly until the support sites associated with the foundation subassembly and the support sites on the installation template engage one another and the foundation subassembly is supported in the confined, substantially unset concrete mass at the installation template. The confined, substantially unset concrete mass is then allowed to set. Also, after the support sites of the template and the support sites associated with the foundation subassembly are engaged and the foundation subassembly is being supported in the confined, concrete mass by the installation template, and before the confined, concrete mass has set, the attitude of the support sites on the template can be adjusted to correct any deviation of the upper support surface of the foundation subassembly from a desired attitude such as a horizontal attitude.

According to another aspect, an assembly comprises a foundation subassembly for supporting a superstructure in a desired attitude at a selected location and a lifting subassembly that is affixed to the foundation subassembly for raising and lowering the foundation subassembly. In this and the other aspects of the invention, the foundation subassembly can comprise a precast concrete upper portion including an upper surface on which the superstructure rests and a lower reinforcing bar subassembly attached to the precast concrete upper portion and extending below the upper surface of the precast concrete upper portion. Also in this and the other aspects of the invention, the lifting assembly can comprise two support arms intersecting one another at substantially right angles, the lifting subassembly being affixed to the foundation subassembly at the upper surface of the precast concrete upper portion of the foundation subassembly.

According to a further aspect, an assembly comprising a foundation subassembly for supporting a superstructure in a desired attitude at a selected location includes an installation template having support sites for supporting the foundation subassembly in place on a support surface at the selected location from support sites associated with the foundation subassembly. The attitude of the support sites on the installation template is adjustable such that the foundation subassembly may be supported from the installation template in a manner so that the superstructure can be supported at the foundation subassembly in the desired attitude. The installation template can comprise a substantially planar frame having four sides of substantially equal length and four corners, with the support sites of the installation template being located substantially at the respective midpoints of the four sides of the substantially planar frame. The installation template can be supported on the support surface at the selected location by four vertically adjustable legs that are located at the four corners of the frame. The support sites associated with the foundation subassembly can be provided at opposite ends of the two intersecting support arms of the lifting subassembly for raising and lowering the foundation subassembly.

For any of the foregoing aspects where the foundation subassembly includes a precast upper portion, the precast concrete upper portion can include a plurality of connecting sites for joining the foundation subassembly to the superstructure and the foundation assembly and the superstructure can be elongated lengthwise relative to their lateral dimensions. Each connecting site can comprise an opening in the precast concrete upper portion of the foundation subassembly that extends through the upper surface of the precast concrete upper portion of the foundation subassembly downwardly toward the reinforcing bar subassembly with a reinforcing bar being embedded in the precast concrete upper portion of the foundation subassembly below the opening, the reinforcing bar having a free end extending upwardly into the opening. A substantially annular splice sleeve can be located within each opening substantially coaxially with the opening, the outer surface of the annular splice sleeve being embedded in the precast concrete upper portion of the foundation subassembly. The free end of the reinforcing bar that extends upwardly into the opening also extends into the interior of the substantially annular splice sleeve. The superstructure can include a plurality of reinforcing bars that are attached to the superstructure and are arranged in a pattern that is substantially complementary with the pattern in which the openings in the precast concrete upper portion of the foundation subassembly are arranged. The superstructure reinforcing bars can include free ends that extend beyond the bottom of the superstructure and are contained within the complementary openings in the precast concrete upper portion of the foundation subassembly, the bottom of the superstructure resting on the upper surface of the precast concrete upper portion of the foundation subassembly. A grouting material can be placed and contained within the openings in the precast concrete upper portion of the foundation subassembly and the interior of the splice sleeves so as to bond the superstructure to the foundation subassembly. Additionally, the upper surface of the precast concrete portion of the foundation subassembly can include a recessed portion for holding grouting material for additionally bonding the foundation subassembly to the superstructure. The reinforced bar subassembly of the foundation subassembly can be embedded in a concrete material contained within an earthen formation at the selected location.

DETAILED DESCRIPTION OF AN INVENTION EMBODIMENT

Figure 1:
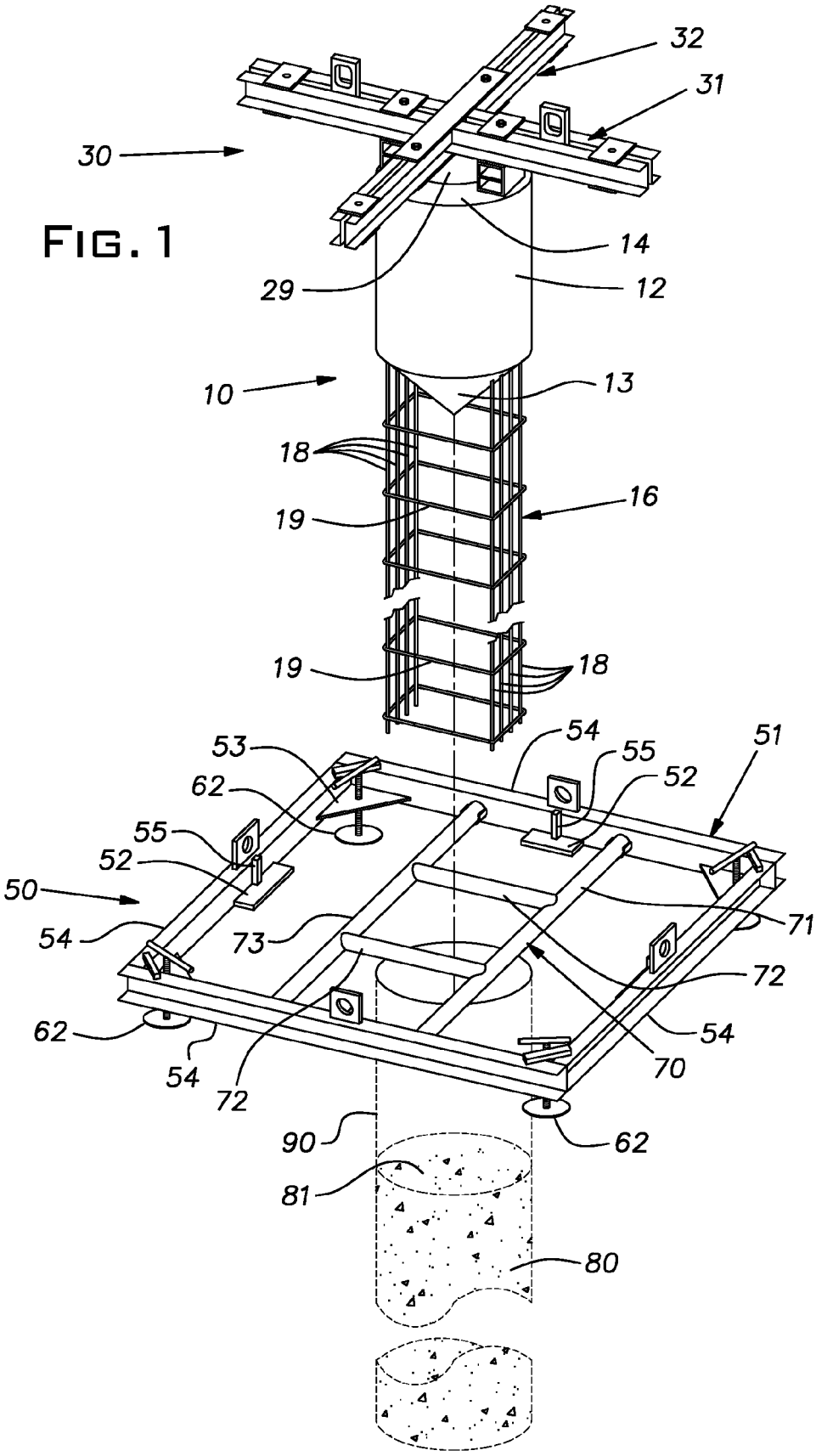
FIG. 1 is a somewhat schematic perspective view of an embodiment of the invention wherein a foundation subassembly for supporting a superstructure is shown about to be lowered into a confined, substantially unset concrete mass using an installation template to support the foundation subassembly in the confined, substantially unset concrete mass in a manner such that the superstructure can be supported in a desired attitude at the foundation assembly. The foundation subassembly and the confined, substantially unset concrete mass are shown foreshortened to facilitate the depiction of the embodiment of the invention.
Figure 6:
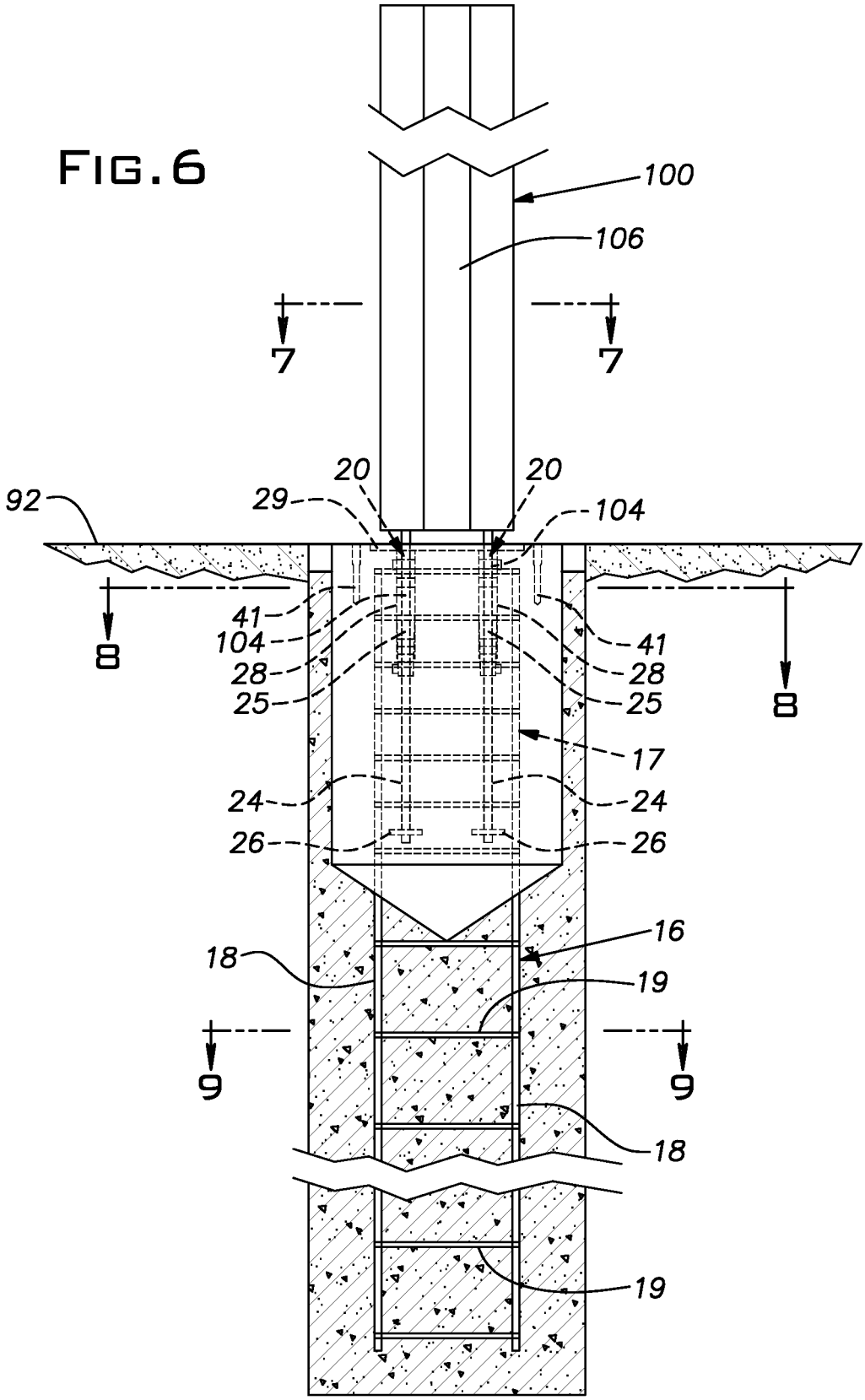
FIG. 6 is a somewhat schematic elevational view, partly in section, of the foundation subassembly of FIG. 1 after it has been lowered into and set in the concrete mass and the superstructure, in the embodiment of a post adapted to hold a panel for deflecting road noise, is about to be seated at the upper surface of the foundation subassembly where it can be supported in a desired attitude. The foundation subassembly and the concrete mass are shown foreshortened to facilitate the depiction of the embodiment of the invention.

FIG. 1 of the drawings illustrates an embodiment of the invention comprising an assembly that includes a foundation subassembly, indicated generally at 10, for supporting a superstructure in a desired attitude at a selected location, a lifting subassembly, indicated generally at 30, secured to the foundation subassembly 10 to aid in raising and lowering the foundation subassembly 10 and an installation template, indicated generally at 50, for supporting the foundation subassembly 10 in a manner such that the superstructure can be supported at the foundation subassembly in the desired attitude upon the lowering of the foundation subassembly into a concrete mass 80. FIG. 1 particularly illustrates aspects of the embodiment of the invention that are related to the installation of the foundation subassembly in the confined, substantially unset concrete mass 80 that is placed into and circumscribed by a cavity or opening 90 that can be made in an earthen formation. FIG. 6, on the other hand, particularly illustrates aspects of the embodiment of the invention after the foundation subassembly 10 has been inserted into the concrete mass 80, the concrete mass has set to form a foundation with the foundation subassembly, the lifting subassembly 30 and the installation template 50 have been removed and the superstructure, indicated generally at 100, is about to be finally installed at the foundation established by the foundation subassembly 10 and the concrete mass 80 by the placement of the base of the superstructure on the foundation subassembly.

In the embodiment of the drawings, both the foundation subassembly 10 and the superstructure 100 are shown as columnar structures such that they are substantially elongated lengthwise relative to their lateral dimensions. However, the invention is not limited to columnar structures and either one or the other of the foundation assembly and the superstructure, or both, can be non-columnar. Additionally, the embodiment of the drawings illustrates the circumstances that would pertain when the foundation subassembly 10 is located within an earthen formation along side a highway, for example, and the superstructure 100 comprises a post for holding panels that present a barrier to noise coming from the traffic passing on the highway. The invention, however, is not limited to such circumstances or such an application. For example, the superstructure can comprise a post or pole for supporting traffic signs and lighting fixtures. And the foundation subassembly 10 can be located in enclosures of various types that contain and confine the concrete mass 80. Additionally, the concrete mass 80 in addition to comprising what is traditionally thought of as concrete, i.e., a construction material including gravel, pebbles or broken stone in a matrix of mortar or cement, can comprise a concrete substitute such as, for example, where fly ash, slag or polymers replace at least some of the mortar or cement.

Figure 9:
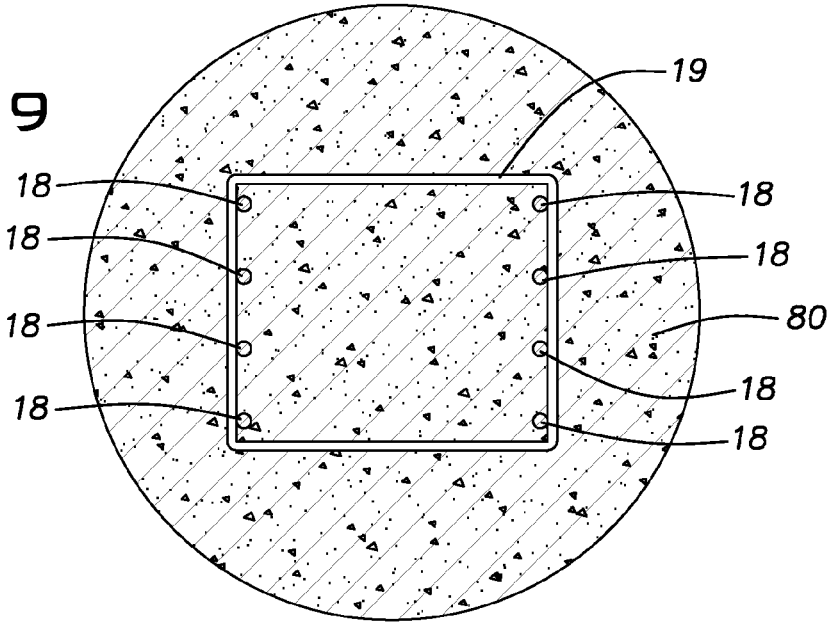
FIG. 9 is a cross-sectional view along line 9-9 of FIG. 6.

Proceeding now to a more detailed description with reference first to FIGS. 1 and 6, the embodiment of the invention shown in the drawings in one aspect comprises a foundation subassembly 10 for supporting a superstructure 100 in a desired attitude at a selected location. The foundation subassembly 10 comprises a precast concrete upper portion 12, including an upper surface 14, and a lower reinforcing bar subassembly, indicated generally at 16, attached to the precast concrete upper portion 12 and extending below the upper surface 14 of the precast upper portion 12. In the illustrated embodiment, as best seen in FIGS. 1 and 6, the precast concrete upper portion 12 is substantially cylindrical in shape with a downwardly projecting portion 13, which can have a conical shape or be wedge-shaped for example, located at the bottom of the upper portion 12. Also, as best seen in FIGS. 1, 6 and 9, the lower reinforcing bar subassembly 16 comprises a cage-like structure made up of a plurality of reinforcing rods 18 and connecting lengths of steel wires 19. One end of each of the rods 18 is embedded in the precast upper portion 12 from where the rod extends downwardly away from the precast upper portion. The plurality of steel wires 19 is spaced along the lengths of the plurality of rods 18, including those portions of the rods that are embedded in the precast upper portion 12, and each one of the steel wires 19 transversely encircles the plurality of rods 18 to form the cage-like structure of the lower reinforcing bar subassembly 16. The top part, indicated generally at 17 in FIG. 6, of the lower reinforcing bar subassembly 16 that is contained within the precast upper portion 12 of the foundation subassembly 10 can be embedded in the precast upper portion by placing the top part 17 of the subassembly 16 within the mold in which the precast concrete upper portion 12 is cast before casting of the upper portion 12.

It will be understood that configurations of the lower reinforcing bar subassembly 16 other than the configuration illustrated in the drawings can be used so long as the lower reinforcing bar subassembly provides for a strong and stable connection between the foundation subassembly 10 and whatever footing to which the lower reinforcing bar subassembly is secured, such as, for example, the concrete mass 80 confined within the cavity 90 in an earthen formation. The precast upper portion 12 of the foundation assembly 10 also can have configurations different from the configuration shown in the drawing. For example, the precast upper portion 12 can have the configuration of a rectangular or square block. The configuration illustrated in the drawings and having the portion 13 that can be conical or wedge-shaped for example, however, is useful for providing easier penetration of the upper portion 12 into the confined, substantially unset concrete mass 80.

Figure 8:
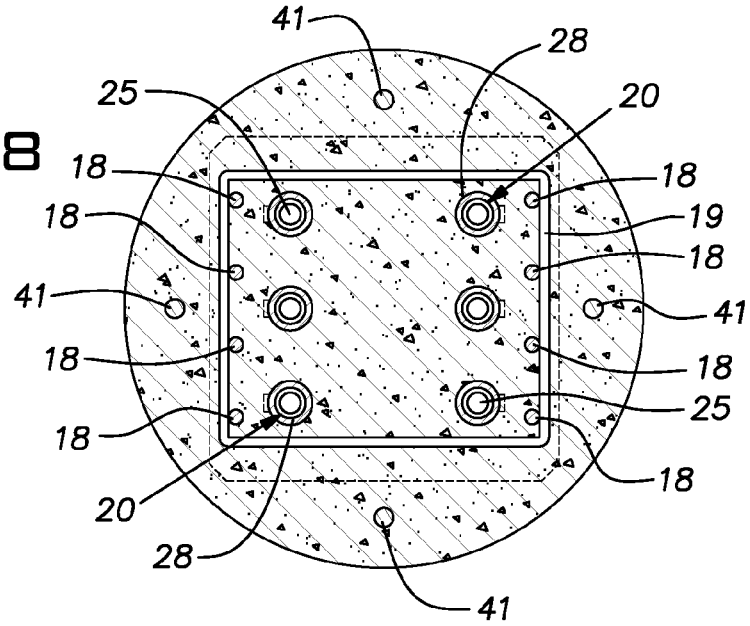
FIG. 8 is a cross-sectional view along line 8-8 of FIG. 6.
Figure 10:
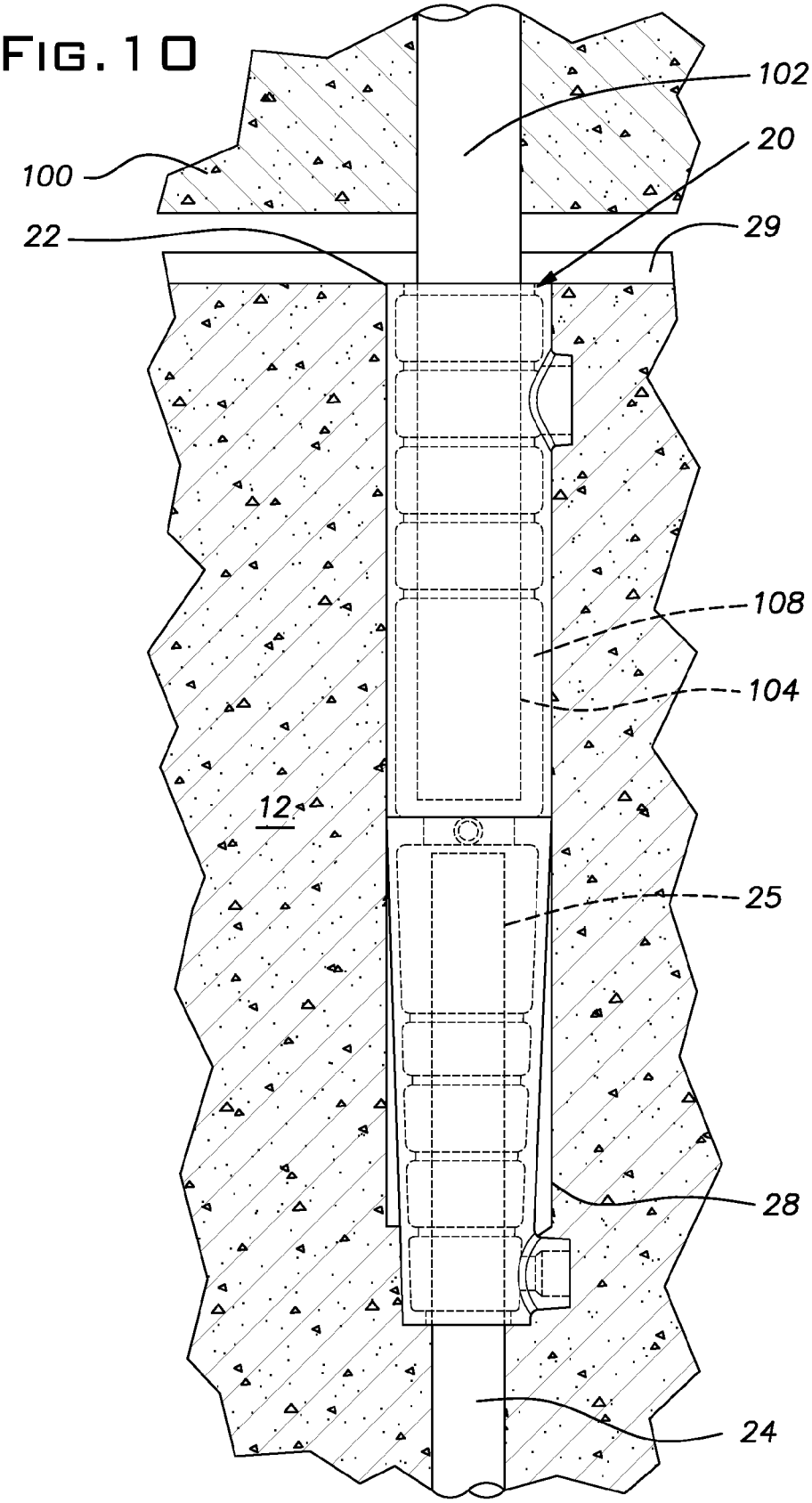
FIG. 10 is an elevational view, partially in section, of one of the connecting sites, including a splice sleeve, that connects the foundation subassembly and the superstructure.

The precast upper portion 12 of the foundation subassembly 10 includes a plurality of connecting sites, indicated generally at 20 in FIGS. 6, 8 and 10 for joining the foundation subassembly to the superstructure 100. In the embodiment shown in the drawings, each connecting site comprises an opening 22 in the precast concrete upper portion 12 that extends through the upper surface 14 of the precast concrete upper portion 12 downwardly toward the reinforcing bar subassembly 16, and a reinforcing bar 24 that is embedded in the precast concrete upper portion 12 below the opening 22 and has a free end 25 that extends upwardly into the opening 20. As with the top part 17 of the lower reinforcing rod subassembly 16 that is embedded in the precast concrete upper portion 12, the reinforcing bars 24 can be embedded in the precast concrete upper portion by placing the reinforcing bars 24 within the mold in which the precast concrete upper portion 12 is cast before casting of the upper portion 12. As best seen in FIG. 8, six connecting sites 20 are provided in the precast concrete upper portion 12 in two opposed groupings of three connecting sites each. The ends of each grouping of bars 24 that are embedded in the concrete upper portion 12 are connected by a metal strap 26 that also is embedded in the precast concrete upper portion 12 as shown in FIG. 6. The metal strap aids in anchoring the bars 24 to the precast concrete upper portion 12.

A substantially annular splice sleeve 28 is located within each opening 22 substantially coaxially with the opening. Certain details of one of the connecting sites, including a splice sleeve, are shown enlarged in FIG. 10. The outer surface of the substantially annular splice sleeve 28 is embedded in the precast concrete upper portion 12 of the foundation subassembly 10. The free end 25 of the reinforcing bar 24 that extends upwardly into the opening 20 also extends into the interior of the substantially annular splice sleeve 28. In addition to the connecting sites 20 for joining the foundation subassembly 10 to the superstructure 100, the upper surface 14 of the precast concrete portion 12 of the foundation subassembly 10 includes a recessed portion 29 for holding a material for bonding the foundation subassembly 10 to the superstructure 100. The manner in which the connecting sites 20 and the recessed portion 29 function to join the foundation subassembly 10 to the superstructure 100 is described in greater detail below.

Figure 4:
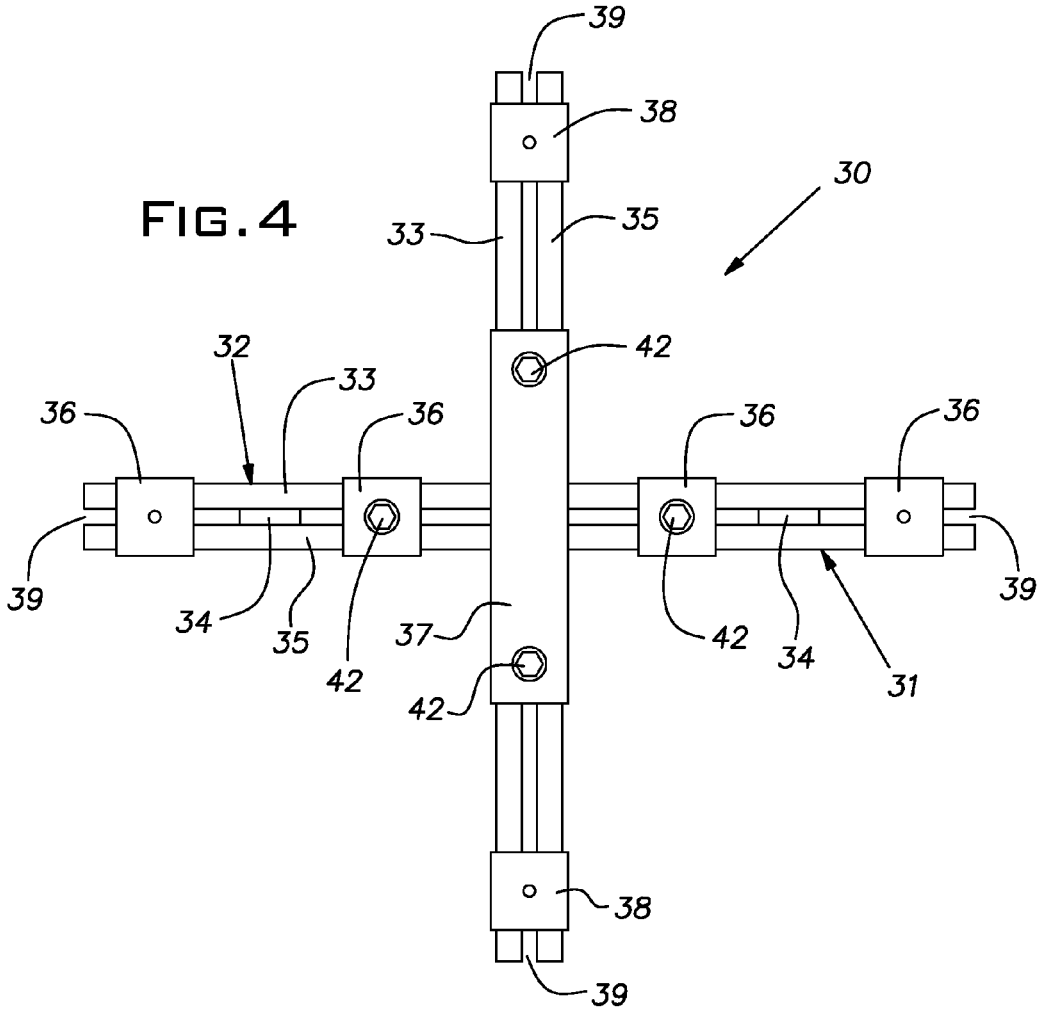
FIG. 4 is a top view of the lifting assembly shown in FIG. 1 used to raise and lower the foundation subassembly of FIG. 1.
Figure 5:
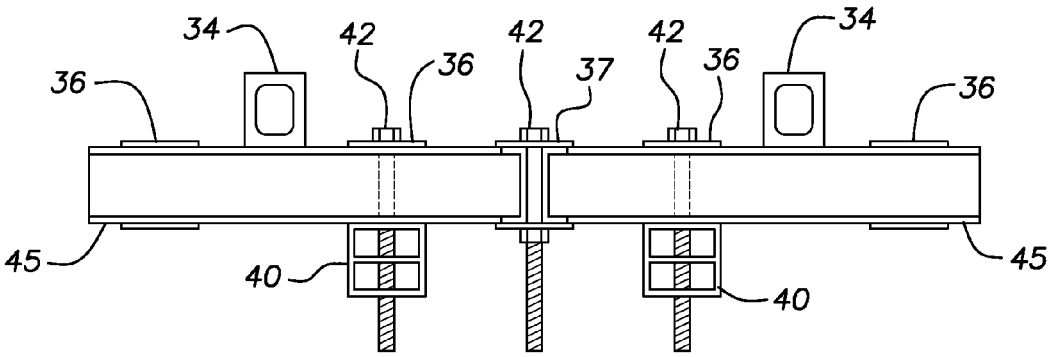
FIG. 5 is a side elevational view of the lifting assembly of FIG. 4.

The embodiment of the invention shown in the drawings in another aspect comprises an assembly that includes foundation subassembly 10 for supporting the superstructure 100 in a desired attitude at a selected location and lifting subassembly 30 for raising and lowering the foundation subassembly. The foundation subassembly 10 as having a precast concrete upper portion 12, including an upper surface 14, and a lower reinforcing bar subassembly 16 attached to the precast concrete upper portion and extending below the upper surface of the precast concrete upper portion has been described above. With respect to the lifting subassembly 30, as best seen in FIGS. 1, 4 and 5, the lifting subassembly comprises two support arms, indicated generally at 31 and 32, that intersect one another at substantially right angles. The lifting subassembly 30 is secured to the foundation subassembly 10 at the upper surface 14 of the precast concrete upper portion 12 of the foundation subassembly through the instrumentalities of the arms 31 and 32.

Referring to FIGS. 4 and 5, it can be seen that the two intersecting arms 31 and 32 of the lifting assembly 30 can be similarly constructed. Each arm comprises a pair of U-shaped channel members 33 and 35 that are arranged back-to-back so that the bottoms of the channel members face one another. The channel members 33 and 35 that form arm 31 are joined together by the metal plates 36 that are fastened such as by welding to the channel members, and the channel members 33 and 35 that form arm 32 are joined by the metal plates 37 and 38 that are fastened such as by welding to the channel members 33 and 35. When the channel members are placed back-to-back, they are not placed in an abutting relationship but are spaced apart so that slots 39 are created at the ends of the arms 31 and 32 for a purpose to be described below.

Steel spacers 40 are fastened as by welding to the bottom of arms 31 and 32. The bottoms of these spacers 40 engage the upper surface 14 of the precast concrete upper portion 12 of the foundation subassembly 10 when the lifting assembly 30 is secured to the precast upper portion 12. In this connection, and referring to FIGS. 6 and 8, four coil inserts 41 equally spaced around the upper surface 14 of the precast upper portion 12 of the foundation subassembly 10 are embedded in the precast upper portion 12. The coil inserts 41 are arranged to match up with bolts 42, that depend from steel plates 36 and 37 that are fastened to arms 31 and 32, respectively, and pass through the spacers 40. The lifting subassembly 30 is secured to the precast upper portion 12 of the foundation subassembly 10 by screwing the bolts 42 into the coil inserts 41 so that the bottoms of the spacers 40 bear down on the upper surface 14 of the precast upper portion 12 of the foundation subassembly 10.

In the embodiment shown in the drawings, lifting eyes 34 are attached as by welding to the tops of the arms 31 and 32 and serve as means to which a lifting means may be attached and the foundation assembly 10 raised and lowered when the lifting assembly is secured to the precast upper portion 12 of the foundation subassembly. Typically, the lifting means would comprise a mobile crane but other types of lifting mechanisms can be employed. Also, means such as hooks, for example, can be used in place of the lifting eyes.

The embodiment of the invention shown in the drawings in another aspect comprises an assembly that includes foundation subassembly 10 for supporting superstructure 100 in a desired attitude at a selected location, lifting subassembly 30 for raising and lowering the foundation subassembly and installation template 50 for supporting the foundation subassembly in the confined, substantially unset concrete mass in a manner so that the superstructure 100 when installed can be supported from the foundation subassembly in the desired attitude. The installation template 50 also can serve to assist in accurately denoting the place at the selected location where the foundation subassembly is to be installed by circumscribing the location of the concrete mass as will be described. The foundation subassembly 10 as having a precast concrete upper portion 12 including an upper surface 14 and a lower reinforcing bar subassembly 16 attached to the precast concrete upper portion below the upper surface of the precast concrete upper portion has been described above, and it is noted here that at least a substantial portion of the foundation subassembly can be contained within the confined concrete material 80 at the selected location when the foundation subassembly is inserted into the concrete material as shown in FIG. 6. Also previously described is the lifting mechanism 30 as comprising two support arms 31 and 32 intersecting one another at substantially right angles with the lifting mechanism being secured generally to the foundation subassembly 10 at the upper surface 14 of the precast concrete upper portion 12 of the foundation subassembly. Noted here is the fact that each of the two intersecting support arms 31 and 32, as shown in FIG. 5, have opposite ends at which are located support sites 45 associated with the foundation subassembly 10. The support sites 45 are associated with the foundation subassembly 10 in the sense that it is the placement of these support sites 545 on adjustable support sites on the installation template 50 that determines the placement and attitude of the upper surface 14 of the precast concrete upper portion 12 of the foundation subassembly 10. And it is the placement and attitude of the upper surface 14 that establishes the placement and attitude of the superstructure 100 supported by the foundation subassembly 10 as will be more fully appreciated from the description that follows.

Figure 2:
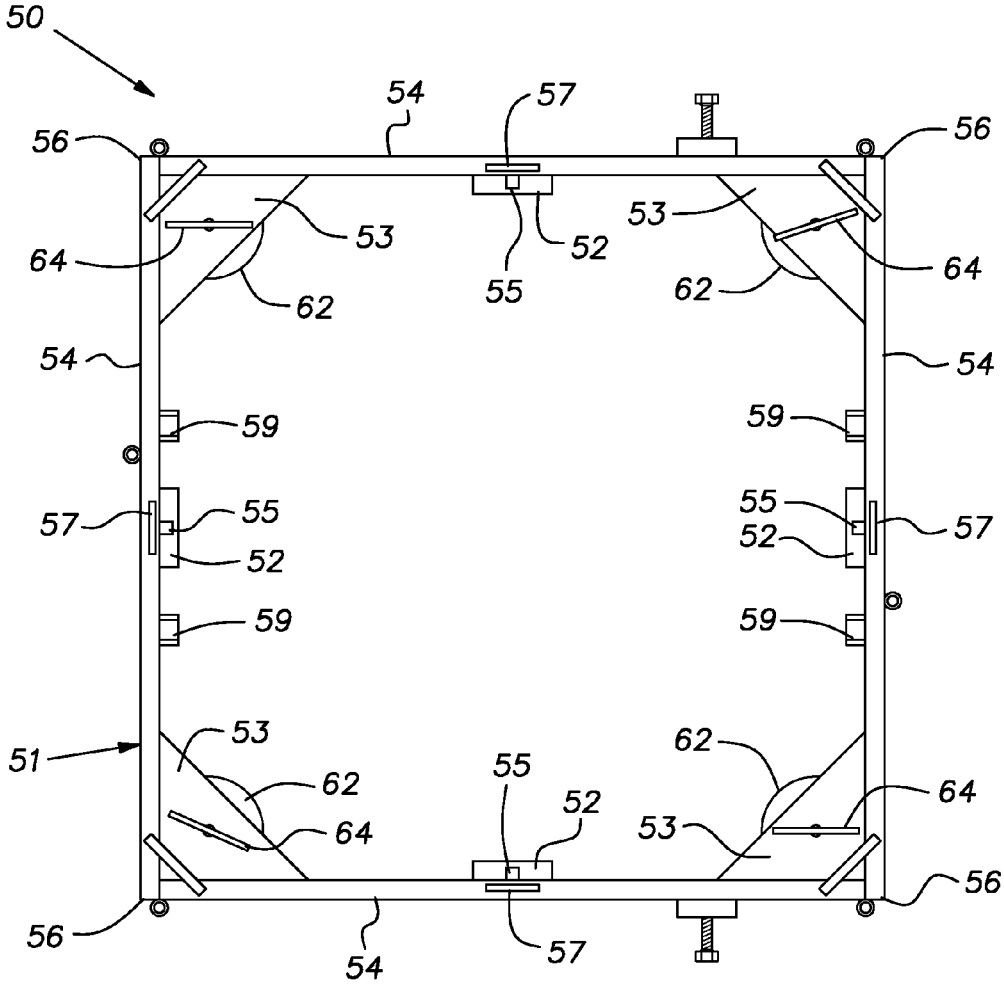
FIG. 2 is a top view of the installation template shown in FIG. 1.
Figure 3:
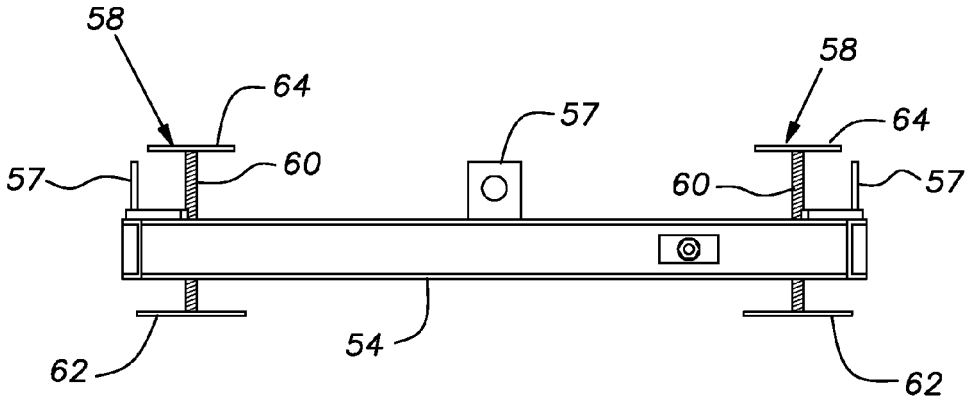
FIG. 3 is a side elevational view of the installation template shown in FIG. 2.

With respect to the installation template 50, as best seen in FIGS. 1, 2 and 3, the installation template has support sites 52 for supporting the foundation subassembly 10 in place at the selected location from the support sites 45 associated with the foundation assembly 10. As will be described further below, the attitude of the support sites 52 on the template 50 is adjustable such that the foundation subassembly 10 may be supported from the installation template in a desired attitude. Stated otherwise, when the foundation subassembly 10 is being installed, the installation template 50 rests on a support surface 92, identified in FIG. 6, at the selected location and the installation template includes the support sites 52 which come into in engagement with the support sites 45 associated with the foundation subassembly 10 as the foundation subassembly is lowered into the confined, substantially unset concrete mass 80, whereby the foundation subassembly 10 is supported by the installation template 50. And because the installation template support sites 52 are adjustable, the attitude of the foundation subassembly 10 may be adjusted.

Referring to FIGS. 2 and 3, the installation template 50 is there shown as comprising a planar frame, indicated generally at 51, having four sides 54 of substantially equal length and four corners 56 with the support sites 52 of the installation template being located substantially at the respective midpoints of the four sides 54 of the substantially planar frame 51. The installation template 50 is supported on a support surface such as support surface 92 by four vertically adjustable legs, indicated generally at 58, that are located at the four corners 56 of the frame. More specifically, in the illustrated embodiment, each of the four sides 54 comprises a U-shaped channel member that is welded at its ends at right angles to adjacent U-shaped channel members to form a substantially square installation template frame 51. A triangular plate 53 is welded at each of the corners 56 where respective sides 54 of the frame 51 are joined so as to provide strength to the joint. Each of the triangular plates 53 includes a threaded through-hole which holds a threaded rod 60 that comprises a component of an adjustable leg 58. One end of each rod 60 is fixed to a foot-plate 62 by means of which the installation template frame 51 is supported at the surface, such as support surface 92, on which the foot-plates 62 rest. The ends of the threaded rods 60 that are opposite the rod ends fixed to the foot-plates 62 are provided with a turning rod 64 by means of which the threaded rods can be turned within the threaded through-holes in the triangular plates 53 so that the spacing between the surface on which the foot-plates 62 rest and the sides 54 of installation template frame 51 to which the support sites 52 are attached can be adjusted. This adjustment feature allows the installation template frame 51 to be adjusted in relation to the surface on which the foot-plates 62 rest so that the installation template frame together with the support sites 52 can be made to assume a desired attitude such as a horizontal attitude.

In the embodiment illustrated in the drawings, the support sites 52 comprise plates that are welded to the respective midpoints of the four sides 54 of the installation template frame 51 at the inner surfaces of the sides 54 and that project inwardly of the frame 51. These support site plates 52 all lie in the same plane, and the support sites include vertically upstanding square rods 55 that are welded to the inner surfaces of respective frame sides 54. These square rods 55 provide aligning guides for the slots 39 at the opposite ends of the arms 31 and 32 of the lifting subassembly 30 when the foundation subassembly 10 is lowered onto the installation template 50 so that the support sites 45 at the ends of arms 31 and 32 will properly come to rest at the support sites 52 on the installation template.

Also attached to the midpoints of the frame sides 54 at the tops of respective ones of the frame sides are lifting eyes 57. These lifting eyes serve as a locations where lifting equipment can be connected so that the installation template 50 can be raised and lowered to and from supporting surfaces and moved from location to location. Four semi-circular holding elements 59 also are provided on the inside of the installation template frame. The holding elements 59 are attached to the inner surfaces of two of the frame sides 54. A first pair of the holding elements 59 are located on opposite sides of one of the support sites 52 and a second pair of the holding elements 59 are located on opposite sides of the opposite support site 52 such that the two pairs of holding elements face one another across the interior of the frame 51. All four holding elements lie in substantially the same plane.

As an adjunct to the installation template 50, in the embodiment of the invention shown in the drawings, there is provided a centering device, indicated generally at 70 in FIG. 1. The centering device includes a three-legged component comprising a first primary leg 71 and two secondary legs 72 that are fixed at respective ones of their ends to the primary leg 71. The primary leg 71 is supported at its opposite ends in two opposed holding elements 59 at the installation template frame 51. The centering device 70 also comprises a second primary leg 73 that is supported at its opposite ends in the other two opposed holding elements 59 at the installation template frame 51. The ends of the two secondary legs 72 that are opposite the ends of the two secondary legs that are attached to the first primary leg 71 are releasably connected to the second primary leg 73 in any suitable manner familiar to those having ordinary skill in the art. The centering device 70 assists in locating the confined, substantially unset concrete mass 80 so that the foundation subassembly 10 can be accurately inserted into the concrete mass. Thus, the installation template 50 is placed over the concrete mass so that the opening defined between the first primary leg 71, the second primary leg 73 and the two secondary legs 72 is positioned over the concrete mass and the foundation subassembly inserted therethrough.

The embodiment of the invention shown in the drawings in another aspect, as best seen in FIG. 6, comprises an assembly that includes both the foundation subassembly 10 and the superstructure 100 supported in a desired attitude at a selected location at foundation assembly 10. In this aspect, the foundation assembly 10 as described above comprises a precast concrete upper portion, including an upper surface, and a lower reinforcing bar subassembly attached to the precast concrete upper portion and extending below the upper surface of the precast concrete upper portion. Also as described above, the precast concrete upper portion 12 of the foundation subassembly 10 includes a plurality of connecting sites as described above for joining the foundation subassembly to the superstructure.

Figure 7:
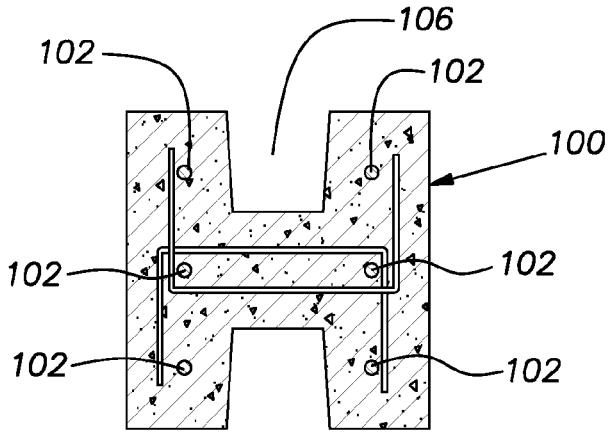
FIG. 7 is a cross-sectional view along line 7-7 of FIG. 6.

The superstructure 100 includes a plurality of reinforcing bars 102 that are attached to the superstructure and arranged in a pattern that is substantially complementary with the pattern in which the connecting sites 20 in the precast concrete upper portion 12 of the foundation subassembly 10 are arranged (see FIGS. 7 and 8). The reinforcing bars 102 extend along substantially the entire length of the superstructure 100 and include free ends 104 that extend beyond the bottom of the superstructure 100 and are contained within the complementary openings 20 in the precast concrete upper portion 12 of the foundation subassembly 10 when the superstructure is installed at the foundation subassembly. When installed, the bottom of the superstructure 100 rests on the upper surface 14 of the precast concrete upper portion 12 of the foundation subassembly 10. As illustrated in FIG. 6, the superstructure 100 is in the process of being brought to rest on upper surface 14 so that a slight gap exists between the bottom of the superstructure and the upper surface 14 at this point in the installation process. When finally installed, the bottom of the superstructure 100 will rest within the recessed portion 29 at the upper surface 14 of the precast concrete upper portion 12 of the foundation assembly 10.

As indicated above, the substantially annular splice sleeve 28 as shown in FIG. 10 is located within each connecting site opening 22 substantially coaxially with the opening with the outer surface of the annular splice sleeve being embedded in the precast concrete upper portion 12 of the foundation subassembly 10. Additionally, the reinforcing bar 24 that is embedded in the precast concrete upper portion of the foundation subassembly below the opening 20 and that has a free end 25 that extends upwardly into the opening 20 also extends into the interior of the substantially annular splice sleeve 28. Grouting material 108 is placed within the interior of the substantially annular splice sleeve and this grouting material binds together the free ends 25 of the reinforcing bars 24 embedded in upper portion 12 of the foundation assembly and the free ends 104 of the superstructure reinforcing bars 102. To provide further bonding between the foundation subassembly 10 and the superstructure 100, the upper surface 14 of the precast concrete portion of the foundation subassembly includes the recessed portion 29 for holding grouting material for bonding the foundation subassembly to the base of the superstructure when the superstructure comes to rest on the foundation subassembly. In this latter connection, the wet grout that is placed in the recessed portion 29 of the upper surface 14 of the foundation assembly is squeezed out from the recessed portion 29 as the superstructure 100 comes to rest at the upper surface 14 of the foundation subassembly 10 within the recessed portion. The wet grout then flows out onto the upper surface 14 and is trowel-finished and applied to the base of the superstructure 100 so as to additionally bond the superstructure to the foundation subassembly 10. A tilt-up brace not shown can be provided in a manner familiar to those having ordinary skill in the art to provide temporary shoring to the superstructure 100 until such time as the grouting has set up and the superstructure is securely joined to the foundation subassembly 10.

Connecting sites provided in the concrete upper portion of the foundation subassembly and reinforcing rods provided in the superstructure, as described above, are only an example of the type of arrangement that can be employed to secure the superstructure to the foundation subassembly. Other securing arrangements can be used as well.

As illustrated in FIGS. 6 and 9, the reinforced bar subassembly 16 of the foundation subassembly 10 can be embedded in the concrete material 80 contained within an earthen formation at the selected location. Also as shown in FIG. 6, the superstructure 100 can comprise a post adapted to hold a panel for deflecting noise. In such a case both the foundation subassembly 10 and the superstructure 100 can be elongated lengthwise relative to their respective lateral dimensions. The slots 106 best seen in FIG. 7 serve to hold the noise-deflecting panels in place in a manner familiar to those having ordinary skill in the art.

Attention is now given, with reference to the drawings, to aspects of the embodiment of the invention shown in the drawings that are related to methods of installing a foundation that includes the foundation assembly 10 at a selected location so that the superstructure 100 may be supported in a desired attitude at the foundation. In one of the aspects of the installation methods, there is placed at the selected location on a support surface such as surface 92 in a manner to support the foundation subassembly 10 at the selected location the installation template 50 having support sites 52 for supporting the foundation subassembly from support sites 45 associated with the foundation subassembly. The attitude of the support sites 52 on installation template 50 is adjusted in relation to the attitude of the support sites 45 associated with the foundation subassembly 10 so that the installation template will support the foundation subassembly in a manner such that the superstructure 100 can be supported in said desired attitude at the foundation. More specifically, and by way of example, after the installation template is put in place at the selected location and is being supported from such as a support surface 92, the vertically adjustable legs 58 at the corners of the installation template frame 51 can be adjusted in the frame 51 by rotating appropriate ones of the threaded rods 60 in the through-holes provided in the triangular plates 53 so as to adjust the attitude of the installation template 50 relative to the support surface and at the same time place all four of the support site plates 52 in a desired attitude such as in a horizontal alignment. The foundation assembly 10 is placed onto the installation template 50 so that the support sites 45 associated with the foundation subassembly and the support sites 52 on the installation template engage one another and the foundation subassembly is supported at the selected location by the installation template. The foundation assembly 10 then is fixed in place at the selected location.

In another one of the aspects of the installation methods, a confined, substantially unset concrete mass 80 having an upper surface 81 is provided at the selected location. The installation template 50 is placed over the upper surface of the confined, substantially unset concrete mass in a manner to support the foundation subassembly 10 in the confined, substantially unset concrete mass. The foundation assembly is inserted into the confined, substantially unset concrete mass 80 through the upper surface 81 of the concrete mass until the support sites 45 associated with the foundation assembly and the support sites 52 on the installation template engage one another and the foundation subassembly 10 is supported in the confined, substantially unset concrete mass 80 by the installation template. The confined, substantially unset concrete mass then is allowed to set.

In a further one of the aspects of the installation methods, the foundation subassembly 10 as described above as including the precast concrete upper portion 12 having an upper surface 14 and the lower reinforcing bar subassembly 16 attached to the precast concrete upper portion below the upper surface of the precast concrete upper portion is secured to the lifting assembly 30. The lifting subassembly, as described above as including two support arms 31 and 32 that intersect one another at substantially right angles is secured to the foundation subassembly 10 at the upper surface 14 of the precast concrete upper portion 12 of the foundation subassembly. As earlier described, each of the two intersecting support arms 31 and 32 have opposite ends at which are located the support sites 45 associated with the foundation subassembly 10. The foundation subassembly is raised into a position above the upper surface 81 of the confined, substantially unset concrete mass 80 by the lifting of the lifting assembly 30 by such as a mobile crane and the foundation subassembly 10 is inserted and lowered into the confined, substantially unset concrete mass 80 by the lowering of the lifting subassembly 30 so that the lower reinforcing bar subassembly 16 of the foundation subassembly 10 is inserted into the confined, substantially unset concrete mass 80 while the upper surface 14 of the precast concrete upper portion of the foundation subassembly 10 is maintained above the upper surface 81 of the confined, substantially unset concrete mass 80. Of course, the upper surface 81 of the confined, substantially unset concrete mass 80 will rise in the cavity 90 as the foundation subassembly 10 is lowered into the concrete mass.

It will be appreciated that in lowering the foundation subassembly 10 onto the installation template 50, the centering device 70 on the installation template aides in accurately identifying the location of the concrete mass 80. However, the centering device interferes with the lowering of the foundation subassembly 10 sufficiently to allow the support sites 45 associated with the foundation assembly to come to rest on the support sites 52 of the installation template 50. Consequently, the centering device 70 must be removed from the installation template 50 before the foundation subassembly is completely lowered. This is accomplished by rotating the first primary leg 71 upwardly so that the two secondary legs 72 that are releasably attached to the second primary leg 73 become disengaged from the second primary leg and also rotate upwardly away from the second primary leg. The first primary leg 71 can then be lifted from the holding elements 59 and removed, along with the secondary legs 72, from under the lifting assembly 30 secured at the upper surface 14 of the foundation subassembly 10. Similarly, the second primary leg 73 can then be lifted from the holding elements 59 in which it rests and removed from under the lifting subassembly 30. The foundation subassembly 10 can then be lowered further to place the support sites 45 and 52 into engagement with one another.

If required, after the support sites 52 of the template and the support sites 45 associated with the foundation subassembly 10 are engaged and the foundation subassembly is being supported in the confined, concrete mass 80 by the installation template 50, and before the confined, concrete mass has set, the attitude of the support sites 52 on the installation template can be adjusted to correct any deviation of the upper surface 14 of the precast concrete upper portion 12 of the foundation subassembly 10 from the desired attitude such as the horizontal.

In a further one of the aspects of the installation methods, and for the purpose of securing the superstructure 100 to the foundation subassembly 10, the precast concrete upper portion 12 of the foundation subassembly includes the plurality of connecting sites 20 as described above and the superstructure 100 includes the plurality of reinforcing bars 102 having free ends 104 as described above that are inserted into the connecting sites. To install the superstructure 100 on the foundation subassembly 10, after grouting material 108 has been deposited in the interior of the splice sleeves 28 the superstructure 100 is raised by a suitable means and directed downwardly toward the upper surface 14 of the foundation subassembly so that the free ends 104 of the superstructure reinforcing bars 102 are inserted into the complementary openings 22 in the precast concrete upper portion 12 of the foundation subassembly and into the interiors of the substantially annular splice sleeves 28 until the bottom of the superstructure comes to rest on the upper surface 14 of the precast concrete upper portion 12 of the foundation subassembly 10. In a particular case where it is desired that the superstructure be installed in a vertical attitude, the upper surface 14 of the foundation subassembly is cast so that it will be parallel to the support sites 45 on the lifting subassembly 30 when the lifting subassembly is secured to the precast concrete upper portion 12 of the foundation subassembly. At the same time, the connecting sites 20 are arranged so that they are generally perpendicular to the upper surface 14 of the foundation subassembly. Also, the installation template 50 will have been set in place and appropriately adjusted so that the support sites 52 have a horizontal attitude.

As far as the superstructure 100 is concerned, the reinforcing bars 102 are aligned generally parallel to the elongated extent of the superstructure and perpendicular to the bottom surface of the superstructure. After the free ends 104 of the reinforcing bars 102 have been inserted into the openings 22 in the connecting sites 20 containing the grouting material 108 and the superstructure has come to rest on the upper surface 14, the superstructure is supported in a substantially vertical attitude such as by a tilt-up brace not shown. As the grouting material at the connecting sites 20 and the grouting material that has flowed out of the recessed portion 29 of the upper surface 14 of the foundation subassembly and been applied to the base of the superstructure harden, the superstructure 100 is bonded to the foundation subassembly by the bonding together of the free ends 104 of the superstructure reinforcing rods 102 and the free ends 25 of the reinforcing rods 24 at the connecting sites 20 and the additional bonding of the base of the superstructure 100 to the upper surface 14 of the foundation subassembly 10. The foregoing description represents the typical case in connection with the installation of posts for supporting road-noise barriers where both the foundation subassembly and the superstructure are substantially elongated lengthwise relative to their lateral dimensions.

As applied in a particular aspect and referred to above, the selected location can comprise an earthen formation. In that case, the confined, substantially unset concrete mass 80 can be provided by using an auger to provide an opening or cavity such as at 90 in FIG. 1 in the earthen formation and the unset concrete can be placed into the cavity in the earthen formation to form a pile.

While various embodiments of the invention have been shown and described herein, it is to be understood that the invention is not so limited but covers and includes any and all modifications and variations that are encompassed by the following claims.

What is claimed is:

1. An installed foundation subassembly for supporting a superstructure in a desired attitude at a selected location, the foundation subassembly comprising a precast concrete upper portion having an upper surface and a bottom, and a lower reinforcing bar subassembly, said lower reinforcing bar subassembly comprising one or more reinforcing rods, said one or more reinforcing rods being partially embedded in the precast concrete upper portion by having been casted into the precast concrete upper portion when the precast concrete upper portion was casted, the lower reinforcing bar subassembly extending from the bottom of the precast concrete upper portion, the precast concrete upper portion having, extending from the upper surface thereof, one or more connecting sites for joining the foundation subassembly to the superstructure, the precast concrete upper portion having been cast at a location other than the selected location, wherein the lower reinforcing bar subassembly extends into concrete located in a cavity in an earthen formation at the selected location and forms a pile and wherein all or substantially all of the precast concrete upper portion is located in the cavity in the earthen formation above a lower portion of the lower reinforcing bar subassembly, the lower reinforcing bar subassembly extending downwardly a first distance from a first portion of the bottom of the precast concrete upper portion, the first distance being more than a second distance from the upper surface of the precast concrete upper portion to the first portion of the bottom of the precast concrete upper portion, said lower reinforcing bar subassembly extending downwardly an effective distance into the pile and effectively reinforcing the pile.

2. The installed foundation subassembly of claim 1, wherein the precast concrete upper portion has a plurality of said connecting sites, each connecting site comprising an opening in the precast concrete upper portion that extends downwardly from the upper surface of the precast concrete upper portion.

3. The installed foundation subassembly of claim 2, wherein the precast concrete upper portion comprises a plurality of reinforcing bars embedded in the precast concrete upper portion, one reinforcing bar below each opening, each reinforcing bar having a first end extending upwardly toward or into its respective opening.

4. The installed foundation subassembly of claim 3, wherein a splice sleeve is located within each opening substantially coaxially with the opening, an outer surface of each splice sleeve being embedded in the precast concrete upper portion, and wherein each first end of each reinforcing bar extends upwardly into an interior of its respective splice sleeve.

5. The installed foundation subassembly of claim 2, further comprising the superstructure attached to the foundation subassembly, the superstructure having a plurality of reinforcing bars extending from a bottom of the superstructure, each said superstructure reinforcing bar having an end portion, each end portion extending into and being fixed within a respective one of said openings.

6. The installed foundation subassembly of claim 5, wherein a splice sleeve is located within each opening substantially coaxially with the opening, and wherein each end portion extends into and is fixed via grouting material within a respective one of said splice sleeves.

7. The installed foundation subassembly of claim 5, wherein the superstructure is part of a wall comprising a panel for deflecting noise.

8. The installed foundation subassembly of claim 1, wherein the upper surface of the precast concrete upper portion includes a recessed portion for holding grouting material for bonding the foundation subassembly to the superstructure.

9. The installed foundation subassembly of claim 1, wherein the precast concrete upper portion has a cylindrical side surface.

10. The installed foundation subassembly of claim 1, the lower reinforcing bar subassembly extending downwardly through most of the pile.

11. The installed foundation subassembly of claim 1, the lower reinforcing bar subassembly having a bottom defined by the distal end or ends of one or more reinforcing rods, said distal end or ends being contacted and supported only by concrete located in the cavity.

12. The installed foundation subassembly of claim 1, the portion of the lower reinforcing bar subassembly which extends below the first portion of the bottom of the precast concrete upper portion comprising a plurality of vertical reinforcing rods and one or more horizontally-oriented cross-piece elements.

13. The installed foundation subassembly of claim 1, wherein the bottom of the precast concrete upper portion is cone-shaped.

14. The installed foundation subassembly of claim 1, the first distance being substantially more than the second distance.

15. The installed foundation subassembly of claim 1, the portion of the lower reinforcing bar subassembly which extends below the first portion of the bottom of the precast concrete upper portion comprising three vertical reinforcing rods.

16. The installed foundation subassembly of claim 1, the portion of the lower reinforcing bar subassembly which extends below the first portion of the bottom of the precast concrete upper portion comprising four vertical reinforcing rods.

17. The installed foundation subassembly of claim 1, the portion of the lower reinforcing bar subassembly which extends below the first portion of the bottom of the precast concrete upper portion comprising six vertical reinforcing rods.

18. The installed foundation subassembly of claim 1, the portion of the lower reinforcing bar subassembly which extends below the first portion of the bottom of the precast concrete upper portion comprising a plurality of vertical reinforcing rods and a horizontally-oriented crosspiece element defining an aperture and which constrains the vertical reinforcing rods.

19. The installed foundation subassembly of claim 1, the portion of the lower reinforcing bar subassembly which extends below the first portion of the bottom of the precast concrete upper portion comprising four vertical reinforcing rods and two horizontally-oriented crosspiece elements, each of which constrains the four vertical reinforcing rods.

20. The installed foundation subassembly of claim 19, wherein each crosspiece element forms substantially a rectangle.

21. The installed foundation subassembly of claim 1, wherein each of the reinforcing rods extends downwardly from the bottom of the precast concrete upper portion without bending.

22. The installed foundation subassembly of claim 1, the first distance being at least 3 times the second distance.

23. The installed foundation subassembly of claim 1, the first distance being at least 2 times the second distance.

* * * * *